United States Patent [19]

Thompson

[11] Patent Number: 4,561,124

[45] Date of Patent: Dec. 31, 1985

[54] KNEE PADDING FOR WORK PANTS

[76] Inventor: Albert N. Thompson, 592 Gunn Rd., Winnipeg, Manitoba, Canada, R2C 2Z9

[21] Appl. No.: 344,676

[22] Filed: Feb. 1, 1982

[30] Foreign Application Priority Data

| | | | |
|---|---|---|---|
| Feb. 20, 1981 | [CA] | Canada | 371334 |
| Jun. 29, 1981 | [CA] | Canada | 380828 |
| Jul. 6, 1981 | [CA] | Canada | 381220 |

[51] Int. Cl.[4] ..... A41D 13/00

[52] U.S. Cl. ..... 2/23; 2/227

[58] Field of Search ..... 2/24, 2, 227, 23

[56] References Cited

U.S. PATENT DOCUMENTS

| | | | |
|---|---|---|---|
| 727,243 | 5/1903 | White | 2/23 |
| 1,636,553 | 7/1927 | Cruden . | |
| 2,266,886 | 12/1941 | McCoy . | |
| 2,568,083 | 9/1951 | Mitchell | 2/23 |
| 3,168,746 | 2/1965 | Smith | 2/24 |
| 3,670,339 | 6/1972 | Cooper et al. | 2/24 |
| 4,035,844 | 7/1977 | Atack et al. . | |

FOREIGN PATENT DOCUMENTS

| | | |
|---|---|---|
| 24231 | 6/1886 | Canada . |
| 109886 | 12/1907 | Canada . |
| 237914 | 2/1924 | Canada . |
| 971703 | 7/1975 | Canada . |

*Primary Examiner*—Doris L. Troutman

*Attorney, Agent, or Firm*—Leydig, Voit & Mayer, Ltd.

[57] ABSTRACT

A knee protector for insertion in a pocket in the legs of work pants or the like is of a V-shaped cross-sectional configuration to improve appearance of the pants with the pad in place, to reduce inconvenience of wearing the protector and to provide a self centering effect reducing inadvertent sidewise shift of the padded part of the leg away from its operative position in front of the wearer's knee. A pocket for use with the pad is of a width sufficient for stitching the pocket to the pant leg along a stitch line coincident with the inseam and the outseam of the leg to enable further improvement in the appearance by concealing the stitch line and placing the pocket inside the respective leg. Both the pad and the pocket can also be used with a different pocket or pad, respectively.

19 Claims, 12 Drawing Figures

KNEE PADDING FOR WORK PANTS

BACKGROUND OF THE INVENTION

The present invention relates to knee protectors for use in conjunction with work pants and in particular to knee protectors of the type having a removable cushion-like material inserted within a pocket arranged on the knee of legs of a pair of trousers, working pants or the like. The present invention relates, by the same token, to the structural features of a pocket for use with such knee protector. Also, the present invention relates to the protecting cushion itself.

In a great number of different occupations, it is desirable to protect one or both knees of the worker. Carpenters, electricians, floor tilers, roofers and airline employees loading the luggage and freight into the bellies of the planes are but a few of such occupations. These tradesmen often have to kneel for an extended period of time, and it is important that a suitable padding be provided for the person's knee not only to increase the comfort while working but also to avoid the development of damages to the knee due to its exposure to relatively high pressures while kneeling.

Two basic kinds of knee protectors are known in the art. The first kind is represented by a knitted type knee pad which is pulled directly over the leg. The disadvantage of the pull-on type knee pad is that it restricts at the back of the leg when the knee is bent and also is very warm and thus uncomfortable to wear.

The second group of known knee protectors is secured to the work pants. Basically, the legs of the pants are provided with a rectangular pocket in the knee portion and inserted within the pocket is a generally flat panel of a foam rubber-like material which can be removed when it is desired to wash the pants and reinserted into the pocket afterwards. One of typical features of the known knee protectors of the type of the inserts in work pants is that they attempt to simulate as closely as possible the rounded shape of the knee. This gives rise to a certain discomfort as in certain positions there is not enough air ventilation between the pant leg with the cushion inserted and the knee, thus only partly eliminating one of the problems mentioned in connection with the pull-on type knee pad. Another problem associated with the known work pants of the above type is in that the pocket receiving the cushion distorts to a substantial degree the appearance of the pants while worn. This disadvantage is particularly considerable in work pants or uniforms wherein the appearance of the garment is of virtually the same significance as the effectiveness of the knee protector. Uniforms for tradesmen servicing appliances and uniforms for cargo handling personnel of airlines are typical examples of a field wherein the appearance of the pants is of significance.

Prior art referred to above is exemplified by the embodiments disclosed in Canadian Pat. No. 971,703 issued July 29, 1975 to James Atack et al., U.S. Pat. No. 727,243 issued May 5, 1903 to Martha White and in U.S. Pat. No. 3,168,746 issued Feb. 9, 1965 to R. D. Smith. The above Canadian patent describes athletic trousers including a reinforcing and protecting knee patch provided at the knee of each leg and attached by stitching. In addition, auxilliary pockets may be provided at the knees for the insertion of padding if desired. The knee pads are flat, oval pieces as best seen by schematic representations in FIGS. 1 and 2 of the reference. U.S. Pat. No. 727,243 is an indication that it has long been known to provide pockets at the exterior of the knee portion of the legs of a pair of pants for inserting therein a rectangular pad which can be removed while washing the garment. A flap closing the pocket is also disclosed. Basically the same structure is shown in the aforesaid U.S. patent to R. D. Smith, U.S. Pat. No. 3,168,746.

SUMMARY OF THE INVENTION

It is an object of the invention to further advance the art of knee protectors of the second group as referred to before. In particular, the object of the invention is to provide a knee protecting device of the above type which would secure sufficient ventillation between the knee and the inside of the trouser leg to which the protector is secured while, at the same time, improving the appearance of the trousers by avoiding the substantial distortion of the shape of the front crease of the trousers in the knee portion due to the inserted padding.

There are several aspects of the present invention which contribute to the advance in the art. In one aspect, the present invention provides a knee pad made of a cushioning material for placement into a pocket formed in the knee portion of a trouser leg, the knee pad comprising two generally flat padding panels generally integral with each other and disposed at an angle relative to each other to define a generally straight ridge portion, whereby said pad can be secured to a trouser leg at the knee portion thereof with said ridge generally coextensive with the front crease region of the knee portion.

In accordance with another aspect of the present invention, a padding member or element is provided for use as a padding insert in a leg of a pair of trousers, said padding member comprising two generally planar panel-like sections disposed such that the padding member is of a generally V-shaped cross-sectional configuration.

The knee padding assembly of the present invention can also be defined, in another aspect, as being comprised of a pliable pocket member adapted for stitching to a leg of a pair of trousers at the knee section thereof, and of a resilient padding element complementary with the pocket member, wherein said padding element is comprised of two cushioning panel-like sections combining to form a V-shaped cross-sectional configuration having a ridge extending from a normally upper end of the padding element to a normally lower end thereof, whereby the padding element can be placed into said pocket member when the latter is stitched to the respective leg, such that said ridge is generally parallel with the front crease of the respective leg at the knee portion thereof.

The present invention can be also referred to, in general terms, as providing, in combination with work pants of the type having leg portions, each leg portion having a pliable pocket stitched to the knee part of the respective leg; a padding element complementary with the respective pocket for insertion therein, each padding element being made of a resiliently deformable material and comprising two panel-shaped sections adjoining each other at an angle to form a ridge extending from a normally upper end of the element to a normally lower end thereof, thereby the padding element is of a generally V-shaped cross-sectional configuration.

In a further modification, the present invention provides a knee pad of the above type wherein the generally V-shaped configuration is of the type wherein the pad has two convergent panels and at least one transverse panel to avoid a sharp ridge at the apex of the "V" which might, in certain instances, cause a premature wear of the crease section of a knee portion of a pant leg.

Both the "V"-shaped panel and the distorted panel with the transverse portion replacing the apex section can be either produced such that the pad is preformed, or they can be formed by a flat piece comprised of the respective relatively rigid panels resiliently hinged to each other. The latter embodiment not only reduces the manufacturing costs as it is simpler to produce a flat piece from, say, Neoprene (TM) as opposed to a preformed work piece. Also, the inserting of the panel into a knee padding pocket of work pants is facilitated.

The invention will now be described by way of two alternative preferred embodiments of work pants utilizing two embodiments of the pocket member and one embodiment of the padding element, it being understood that modifications to the shown embodiments are possible within the scope of the present invention. The preferred embodiments will be described with reference to the accompanying drawings.

DETAILED DESCRIPTION OF PREFERRED EMBODIMENTS

Figure 1:
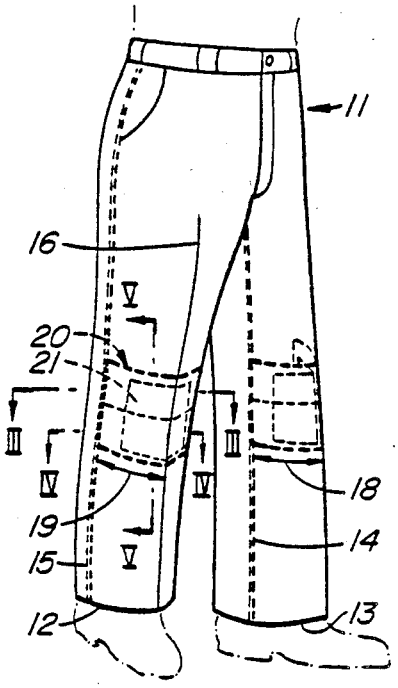
FIG. 1 is a perspective view of a pair of working pants with a diagrammatic indication of the location and shape of the knee protectors.
Figure 2:
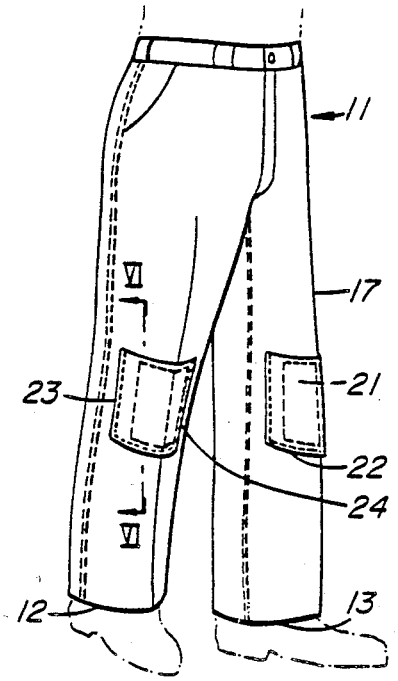
FIG. 2 is a view similar to FIG. 1 but showing a modified embodiment of the work pants utilizing only one aspect of the invention.
Figure 3:
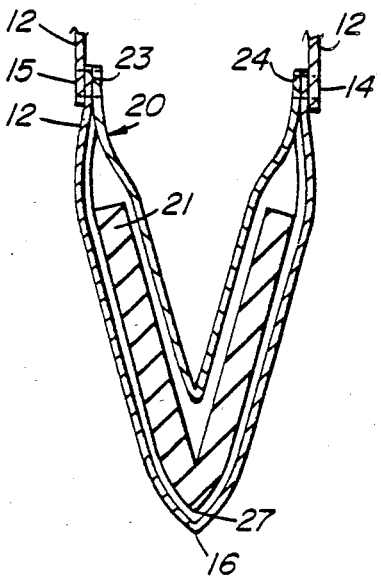
FIG. 3 is section III—III of FIG. 1.

For the sake of simplicity, the individual elements of the embodiments of FIGS. 1 and 2 are shown as being identical to each other and will therefore be referred to with the same reference numerals.

Reference numeral 11 designates a pair of work pants having two legs 12, 13, each leg having an inseam 14, and an outseam 15 transversely opposite to the inseam 14. Reference numeral 16 designates front crease of leg 12 and reference numeral 17 designates similar crease of the leg 13.

As is well known, when the pant legs are flattened such that the creases 16, 17 form the respective edges of the flattened configuration, the inseams 14 and outseams 15 are generally coincident and are slightly closer to the front creases 15 than to the rear creases of the legs. Thus, when the legs are stretched such as to flatten the respective crease 16 or 17 while rendering the inseam and outseam of the respective leg to form the "edge" of the transversely stretched leg, the distance between the two seams as measured across the front crease 16 or 17 is slightly less than the corresponding distance as measured over the rear crease of the respective leg, which is shown by the fabric at the back being loose. This peripheral distance is also referred to as a "front" or "frontal" width of the respective leg. The front width of the respective leg is significant with respect to terminology used hereinafter with respect to some aspects of the present invention. Briefly, the front width is the sum of distance between inseam 14 to crease 17 plus the distance between the crease 16 to the outseam 15, it being understood that reference to the respective portions at both legs is being made strictly for the sake of convenience as the measurements are identical for both legs of the pants. The first measurement is referred to with reference numeral 18, the second with reference numeral 19.

In FIG. 1, a rectangular pocket 20 is shown as being stitched interiorly of each of the legs 12, 13 and receiving a particularly shaped cushion insert 21 as will be described in greater detail later on. FIGS. 1, 3, 4 and 5 show that the pocket 20 is stitched to each respective leg 12, 13 solely along the respective inseam 14 and outseam 15, there being no stitches (FIG. 5) securing the pocket to the respective leg in addition to the two vertical stitch lines. A flap covering the pocket receiving the cushion 21 can also be provided if desired but it was found out that it can be omitted if the cushion is made of a material having sufficient frictional resistance at its surface.

The embodiment of FIG. 2 is different in that the pocket 20 is stitched at the exterior of the respective legs 12, 13. The stitching in this case is not identical with the stitching of the embodiment of FIG. 1 in that the vertical stitch lines of the pocket 20 are spaced from the respective inseam and outseam. The pocket itself, therefore, is of the known type (of the above U.S. patent to R. D. Smith). It is visible, however, even with the pants of FIG. 2, that the particular shape of the cushion 21 as will be referred to hereinafter, still contributes to an improved appearance of the pants. It will be noted that in FIG. 2, the pocket 20 is additionally stitched to the respective leg along a bottom transverse line, at stitch 22. Vertical stitches 23, 24 which, in the embodiment of FIG. 1, are generally indentical with the respective inseam 14 and outseam 15, hold the sides of the respective pocket 20 to the respective leg.

Thus, in summary, the difference between the two embodiments is that FIG. 1 does not have the transverse stitch 22 and in that the vertical stitches 23, 24 in FIG. 1 are coincident with the inseam and with the outseam of the respective leg. It is particularly the embodiment of FIG. 1 that enhances the eye appealing neatness of the pair of legs by concealing the pad inside the respective leg while enhancing, on top of the leg, the continuity of the front crease. However, even with the embodiment of FIG. 2, the appearance of the pants is enhanced by at least generally maintaining the shape of the legs at the crease region of the knee section thereof.

Figure 7:
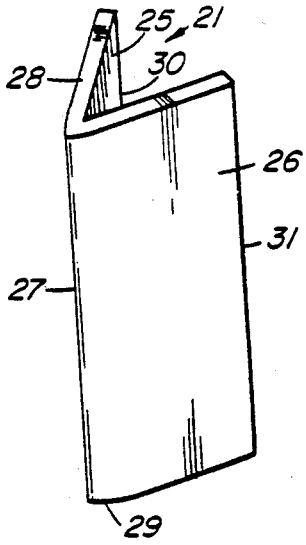
FIG. 7 is a perspective view showing only the padding element insertable into a pocket.

Reference may now be had to the preferred embodiments of the padding element shown in FIG. 7. The padding element or cushion 21 is an integral piece made of neoprene foam. The material is preferred because it is light, resistant to oil or the like, provides sufficiently high friction at the surface relative to the cloth of the pocket and of the pants which is of advantage from the standpoint of keeping the cushion 21 within the pocket 20 by avoiding its undesired "travel" out of the pocket while the person wearing the pants is walking or the like.

The cushion is of a generally rectangular configuration in plan and consists of two rectangular panel-like sections 25, 26, each section 25, 26 being generally planar and being disposed at an angle of slightly less than 90°, to produce a ridge 27 extending from the normally upper end 28 to the normally lower end 29 of the cushion 21. The width of sections 25 and 26 is preferably the same. The overall width from one side 30 to the other side 31 across the ridge 27 is such as to allow for convenient inserting of the cushion 21 into the pocket 20. It was found out that, for instance, with the embodiment of FIG. 1, the width of the cushion 21 can be considerably less than that of the pocket. In one embodiment, for instance, the width of the pocket is about 24 cm while the overall width of the cushion amounted to only about 18 cm.

Those skilled in the art will readily appreciate that a cushion member such as the cushion 21 can be readily used even in conjunction with known types of pockets or pants, for instance, as disclosed in the above Smith U.S. Pat. No. 3,168,746.

Figure 8:
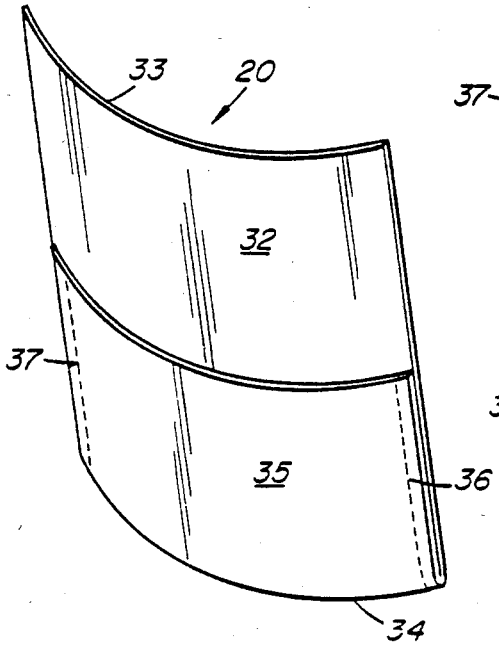
FIG. 8 is a perspective view showing a preferred embodiment of the pocket.

Reference will now be made to FIG. 8 which shows what is believed to be the simplest embodiment of the pocket 20 for use in a combination as shown in FIG. 1. The pocket is made of a pliable textile material. It contains a main panel 32 having a normally upper edge 33 and a normally lower edge 34. The lower edge 34 is formed by a turned-over extension of the fabric, to provide a second panel 35 whose width is generally the same as that of the main panel 32 but the height of the second panel is smaller. The two panels are stitched to each other along sides 36, 37. In accordance with one inventive aspect of the present invention, the spacing between the side 36, 37 is such as to correspond to the distance (18+19) of the leg of work pants with which the pocket is to be used. This allows for stitching of the pocket 20 to the respective leg such that the stitch securing the pocket 20 to the leg 12 or 13 is concealed by making same coincident with the inseam and outseam of the leg.

It will be appreciated on comparing FIGS. 2, 3, 4 and 5 that the second panel is disposed between the main panel 32 and the inside surface of the respective pant leg 12 or 13. The turned-over lower edge 34 of the pocket thus forms the bottom of the pocket when same is stitched to the pants and holds the cushion 21 securely without the need of a transverse stitch such as stitch 22 of FIG. 2.

Figure 9:
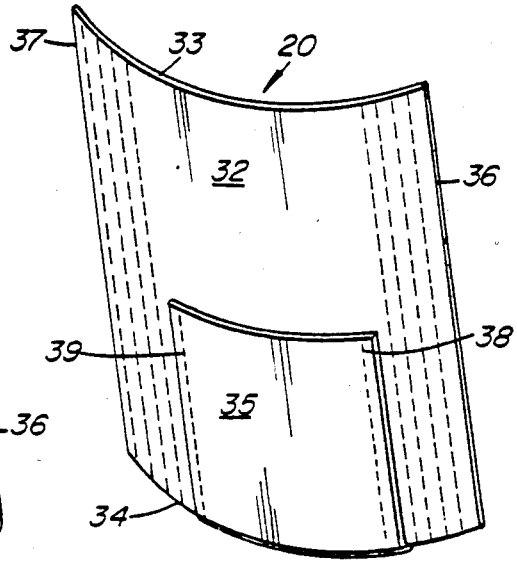
FIG. 9 is a perspective view similar to FIG. 8 but showing another embodiment of the pocket.

FIG. 9 is a perspective view of another embodiment of the pocket 20 which is intended to merely show that the embodiment of FIG. 8 can be modified to a more or less substantial degree without departing from the scope of the present invention. In the embodiment of FIG. 9, the pocket 20 has a main panel having a plurality of stitches along its sides 36, 37 to designate cut lines along which the main panel 32 can be cut to match the respective frontal width of the pant leg with which the pocket is to be used. By the same token, the second panel 35 is shown to be of a width less than that of the main panel, the second panel 35 being stitched to the main panel along side seams 38, 39, spaced apart a distance sufficient for defining a pouch capable of receiving the padding element. Of course, the distance between the side seams 38, 39 is selected such as to allow convenient inserting and removal of a cushion 21.

Figure 10:
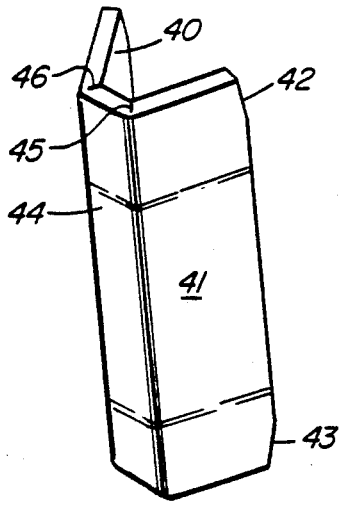
FIG. 10 is a perspective view similar to that of FIG. 7 but showing another embodiment of the padding element.

Turning now to FIG. 10, a modified version of a cushion for use in the present invention is shown. As in FIG. 7, the cushion is made from neoprene and comprises two generally rectangular panel-like sections 40, 41 both of which are generally planar. Preferably, each panel section 40, 41 is bevelled at 42, 43. As in the above described first embodiment of the padding, there is a ridge 44 at the converging sides of panels 40, 41. The ridge 44, however, is of the type of a narrow panel formed by bending an originally flat piece at lines of weakness 45, 46 and then adhesively securing the panels 40,41, and 44 to form the configuration generally as shown in FIG. 10. The padding or cushion member as shown in FIG. 10, therefore, again has a generally V-shaped cross-sectional configuration slightly distorted by the ridge panel 44.

Figure 4:
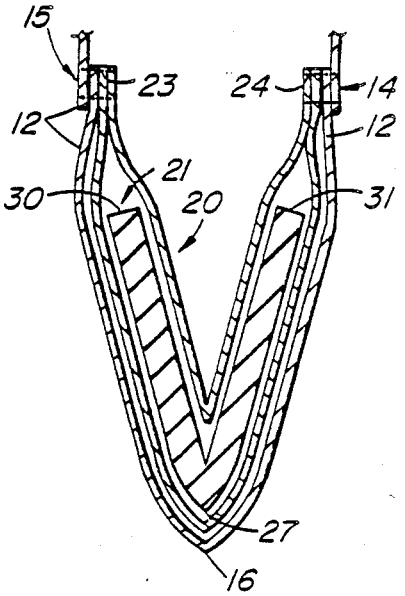
FIG. 4 is section IV—IV of FIG. 1.
Figure 5:
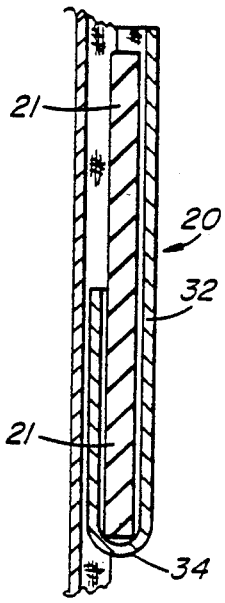
FIG. 5 is section V—V of FIG. 1.
Figure 11:
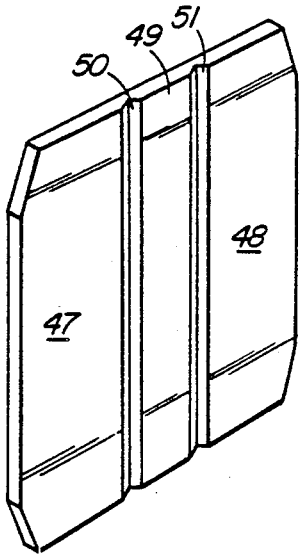
FIG. 11 is a perspective view of a further embodiment of the padding element.

Both the padding of FIG. 10 and the padding of FIG. 4 is produced from a flat piece, one embodiment of which is shown in FIG. 11.

In further development of the present invention it was discovered that it is of advantage not to glue the panels to each other such as to form a generally rigid configuration as in FIG. 7 or in FIG. 10. Instead, if a plain panel is merely provided with suitably located line or lines of weakness, it conforms to the shape of the respective leg of trousers readily. Thus, FIG. 11 shows a further modification of the padding member differing from that of FIG. 10 only in that instead of a rigid angular securement of panels to each other, the panels are resiliently hinged to each other. In FIG. 11, reference numeral 47 denotes one side panel, 48 the other side panel. The panels 47, 48 are integral with a ridge panel 49, by producing the entire member from a neoprene or the like piece provided with lines of weakness 50, 51. It was found out that on inserting of the flat piece of FIG. 11 into a trouser leg, the element assumes generally the position as shown in FIG. 12 without the need of fixed securement of panels 47, 48 and 49 to each other as in the embodiment of FIG. 10.

Figure 12:
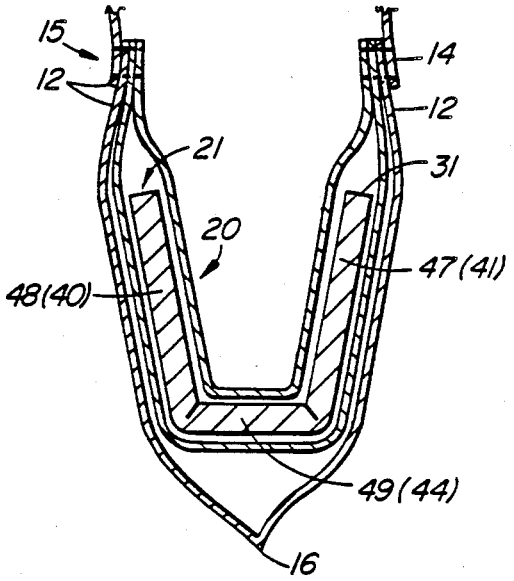
FIG. 12 is a sectional view similar to that of FIG. 4 but showing the arrangement of a padding element of FIG. 10 or 11 in a trouser leg.

The remaining parts of the section of FIG. 12 generally correspond to those of FIG. 4 and are therefore designated with the same reference numerals. It will be observed from FIG. 12 that the pocket 20 conforms to the shape of the padding element as it is only secured to the trouser leg along the sides of the pocket and preferably within the region of the inseam and outseam of the respective leg.

Thus, the present invention provides several vendible products. For instance, the cushion element 21 can be sold separately for use with known work pants having pockets already secured to the knee portion of the legs. The cushion 21 can also be sold as a part of a kit, with a pocket such as the pocket 20 shown in FIG. 8 or 9 adapted to be secured to the inseam and outseam sections of the legs of the work pants. It is not preferred but is conceivable to use the pockets 20 with a different type of cushion, for instance, with the cushion such as described in the above Smith U.S. Pat. No. 3,168,746. Accordingly, the pocket can also be sold separately. It is preferred, however, to combine the pocket with the V-shaped cushion as described above, particularly if the appearance of the crease section of the legs is important.

The generally V-shaped configuration of the padding, apart from improving the overall appearance of the work pants, also provides the feature of "self-centering" of the pant leg on the knee, whereby side-wise displacement from a position of the pad directly in front of the knee is more readily prevented or rectified than with generally flat pads of prior art. This feature is significant in certain applications of the invention, e.g. in baggage handling and loading by airline personnel.

Figure 6:
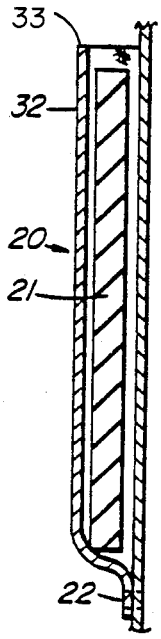
FIG. 6 is section VI—VI of FIG. 2.

Furthermore, the making and selling of work pants having the pocket of FIG. 8 or 9 secured but not necessarily containing the cushion element as described above is also readily conceivable. It is shown by FIGS. 2 and 6 that the inventive cushion can also be used without utilizing the inventive feature allowing for securement of the pocket in the inseam and outseam regions of the legs, without departing from one aspect of the present invention. Another readily conceivable embodiment is the production of the padding member of FIG. 7 in the same fashion as the embodiment shown in FIG. 11, i.e. without a rigid securement of the side panels to the ridge section.

The above are but few examples of different modifications of the preferred embodiments as referred to above, which do not depart from the scope of this invention as recited in the accompanying claims.

I claim:

1. A knee protector adapted to be secured to the knee portion of a trouser leg including an inseam and an outseam, said knee protector including a pocket to be stitched to said leg and a removable padding element complementary with the pocket for insertion into same, wherein said pocket comprises a pliable main panel having a normally top edge portion, a normally bottom edge portion and two side edge portions, the spacing of said side edge portions from each other generally corresponding to the front width of the respective leg at the knee region thereof as measured from the respective inseam, over the front of the knee portion, to the respective outseam, whereby the pockets can be stitched to the respective leg along two lines generally coincident with the inseam and the outseam of the leg, respectively.

2. A knee protector as claimed in claim 1, wherein the normally bottom edge portion of said main panel is integral, over a turned-over portion, with a second panel, the turned-over edge portion forming a bottom section of the pocket, whereby the pocket can be stitched to the respective trouser leg solely along the sides thereof coincident with the respective inseam and outseam.

3. A knee protector as claimed in claim 1 or 2, wherein the size of the main panel is complementary with the size of the padding such that with the padding inserted within the pocket, the main panel covers at least a substantial portion of that surface portion of said padding element which is turned away from the knee portion when the pocket and the padding element are applied to a trouser leg.

4. A pliable pocket for use as a holder for removably securing a knee padding element to a trouser leg including an inseam and an outseam, said pocket including a pliable main panel of a size sufficient to allow stitching thereof to a trouser leg along lines generally coincident with the inseam and with the outseam of the respective leg while keeping the surface of the main panel generally coextensive with the surface of the leg at the knee portion thereof.

5. A pliable pocket as claimed in claim 4, further comprising a second panel integral with said main panel and adjoining same at a turned-over lower edge portion of the main panel, whereby the turned-over edge portion forms a bottom of the pocket, thus allowing the securement of the pocket to the respective trouser leg solely along the inseam and the outseam of the leg and of a padding element within the pocket.

6. A pliable pocket as claimed in claim 4 or 5, wherein said main panel is of the size sufficient for fully covering one surface of a knee padding element when the latter is inserted in said pocket.

7. Pliable pocket means adapted to be stitched to a knee of a trouser leg having an inseam and outseam, said pocket means including a pliable main panel whose width generally corresponds to the front width of the respective leg at the knee portion thereof, as measured from the inseam, over the front of the knee portion of the trouser leg, to the outseam of the leg.

8. Pliable pocket means as claimed in claim 7, further comprising a turned-over edge at the bottom of said pliable main panel, at which the pliable main panel is integral with a turned-over second panel, whereby the turned-over edge portion forms a bottom of said pocket.

9. Pliable pocket means as claimed in claim 8, wherein said second panel is of a length shorter than that of the main panel.

10. A pliable pocket means as claimed in claim 8 or 9, wherein the width of said second panel is generally the same as that of the main panel, whereby both panels can be stitched to the respective leg at the inseam and at the outseam thereof, respectively.

11. Work pants having two legs, each including an inseam and an outseam, at least one of the legs having a pliable pocket for receiving a cushioned member at the knee portion of the leg, said pocket being generally coextensive with a part of the leg at said knee portion, said pocket including a pliable panel generally corresponding in width to the front width of the respective leg as measured from the inseam, over the front of the knee portion of the leg, to the outseam of the respective leg, said panel having two mutually opposite side portions stitched at the inseam and at the outseam, respectively, of the respective leg, to conceal the stitching of the side portions.

12. Work pants as claimed in claim 11, wherein said pocket is disposed at the outer surface of the leg.

13. Work pants as claimed in claim 11, wherein said pocket is disposed at the inner surface of the respective leg.

14. Work pants as claimed in claim 12 or 13, wherein said panel is a main panel merging, at its normally lower edge, over a turned-over edge section, with a second panel disposed between the main panel and the knee portion of the respective leg portion.

15. Work pants as claimed in claim 12 or 13, wherein said panel is a main panel merging, at its normally lower edge, over a turned-over edge section, with a second panel disposed between the main panel and the knee portion of the respective leg portion, the length of said second panel as measured in a direction generally parallel with elongation of the respective leg portion, is shorter than that of the main panel.

16. Work pants as claimed in claim 12 or 13, in combination with a padding disposed within said pliable pockets.

17. Work pants as claimed in claim 12 or 13, in combination with a padding disposed within said pliable pockets, said padding being of the type including two generally identical panel-like portions, integral with each other at a ridge generally coextensive with the front crease of the respective leg portion.

18. Work pants as claimed in claim 12 or 13, in combination with a padding disposed within said pliable pockets, said padding being of the type including two generally identical panel-like portions, integral with each other at an angular ridge generally coextensive with the front crease of the respective leg portion, the length of said padding as measured along the respective crease portion being generally the same as the corresponding length of said main panel, whereby the padding is entirely received within said pliable pocket.

19. A pliable pocket as claimed in claim 5 wherein said padding element is adapted to be received between said main panel and said second panel.

* * * * *